United States Patent [19]

King

[11] 4,321,589

[45] Mar. 23, 1982

[54] DETECTION SYSTEM FOR EMERGENCY VEHICLES WITH SIGNAL PREEMPTION MEANS

[76] Inventor: Frederick N. King, P.O. Box 601, South Pasadena, Calif. 91030

[21] Appl. No.: 166,023

[22] Filed: Jul. 7, 1980

[51] Int. Cl.[3] ..... G08G 1/07; G08G 1/01

[52] U.S. Cl. ..... 340/38 L; 340/32

[58] Field of Search ..... 340/32, 33, 38 L, 35, 340/37; 455/95, 99; 324/228, 234, 236, 260

[56] References Cited

U.S. PATENT DOCUMENTS

| | | | |
|---|---|---|---|
| 2,355,607 | 8/1944 | Shepherd | 340/33 |
| 3,090,042 | 5/1963 | Kleist et al. | 340/38 L |
| 4,016,532 | 4/1977 | Rose | 340/32 |
| 4,038,633 | 7/1977 | King | 340/38 L |

*Primary Examiner*—James J. Groody

*Attorney, Agent, or Firm*—Roger A. Marrs

[57] ABSTRACT

A system for detecting emergency vehicles and providing an apparatus for preempting traffic signals at intersecting streets to assure right-of-way in the direction of travel of emergency vehicles. The apparatus or system includes an alternating current generator installed on emergency vehicles to generate an alternating magnetic field surrounding the vehicle at a frequency or coded frequencies reserved for emergency vehicles and an emergency vehicle detection system which detects only alternating magnetic fields with a frequency or coded frequencies radiated by emergency vehicles.

13 Claims, 4 Drawing Figures

DETECTION SYSTEM FOR EMERGENCY VEHICLES WITH SIGNAL PREEMPTION MEANS

CO-RELATED APPLICATION

This application is co-related to Ser. No. 904,879, filed May 11, 1978, of same title which is now abandoned.

CO-RELATED PATENT

Reference is made to U.S. Pat. No. 4,038,633, King, for the method of detection used in emergency vehicle detection herein described.

BACKGROUND OF THE INVENTION

1. Field of the Invention

This invention relates to devices for detecting emergency vehicles as such and providing means of traffic signal alignment along a city street or roadway in advance of such vehicles to stop all cross traffic and give right-of-way to these vehicles so as to provide rapid, unimpeded movement of emergency vehicles through a city or urban area.

2. Description of the Prior Art

There are several methods of preemption of signals for emergency vehicles in use at present. The most simple of which is a push button installed at fire stations to preempt traffic signals immediately adjacent to the fire station when fire trucks leave on emergency calls. The button is pushed just prior to fire trucks leaving the station. Traffic signals immediately adjacent to the station are preempted to provide right-of-way through these signals for the trucks. A preadjusted timer returns the signal controller to normal operation. This type of preemption is limited to vehicles leaving the fire station and to traffic signals immediately adjacent to the home base of the vehicles. Once the vehicles have passed through these preempted signals, there is no further preemption ahead and the vehicles are forced to weave through traffic, travel on the wrong side of the street and go through red lights hoping cross traffic will heed the siren's wale and flashing red beacon mounted on the vehicle.

A second type of emergency vehicle preemption system utilizes a modulated light source mounted on top of emergency vehicles with a sensor that detects the modulated light mounted on signal standards or a special mounting near the intersection. The circuitry for these systems is complicated, relatively expensive and require considerable maintenance to keep operative. Any obstacle which blocks the light beam such as large trucks in the path can render the system inoperative.

A third type of signal preemption system utilizes portable low power, radar with the transmitter mounted on the emergency vehicle and the receiver located at the signalized intersection. These systems suffer essentially the same problems as modulated light systems.

SUMMARY OF THE INVENTION

This invention provides a detection system for emergency vehicles with a means of preempting traffic signals that is less complicated, more dependable and less expensive than those now in use.

The emergency vehicle detection system in this invention is made up of two separate units. One unit, an A.C. current generator (electro-mechanical or electronic) is mounted on an emergency vehicle which produces a specific alternating magnetic field surrounding the vehicle that identifies it as an emergency vehicle. The second unit, a detector similar to the alternating magnetic field detection system described in the U.S. Pat. No. 4,038,633, King, but of special design, is installed at traffic signal locations to be preempted by the approach of emergency vehicles. The detector filter system is designed to pass only the frequency or frequencies of the alternating magnetic field surrounding emergency vehicles. When emergency vehicles are detected approaching signalized intersecting streets or roadways having the emergency vehicle detection system of this invention installed a call is placed in the traffic signal controller to initiate a signal preemption sequence to stop all cross traffic and provide right-of-way through the intersections for emergency vehicles. A second set of emergency vehicle sensors installed at the intersection returns the traffic signal control to normal operation when the last emergency vehicle is detected at the intersection.

Therefore, it is among the primary objects of the present invention to provide a novel emergency vehicle over-ride apparatus to provide means for selectively controlling intersection traffic lights.

A further object of the present invention resides in providing a novel alternating magnetic field signalling system of special frequency to provide means for controlling intersection traffic lights in response to the presence of an emergency vehicle.

Still a further object of the present invention is to provide a novel alternating magnetic field apparatus incorporating economic construction and installation for transmitting or emitting special alternating magnetic fields and means responsive to the signals for initiating a control sequence for controlling traffic lights favorable to an oncoming emergency vehicle.

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

The present invention discloses a detection system for sensing the presence of emergency vehicles as distinguished from conventional motor-driven vehicles traveling along a roadway and provides a means of traffic signal preemption ahead of emergency vehicles to halt all cross traffic and establish right-of-way through traffic signals for emergency vehicles to insure rapid and safe movement of these vehicles through a city or urban area. This invention comprises an AC current generator (electromechanical or electronic) of special design installed on emergency vehicles to generate an alternating magnetic field with a frequency or coded frequencies outside the band of frequencies radiated by conventional motor-driven vehicles (10 KHz selected to describe this system) and a special design of the vehicle detection system described in U.S. Pat. No. 4,038,633, King, the filter section of which is designed to pass only the frequency or coded frequencies of the alternating magnetic field radiated by emergency vehicles. The emergency vehicle detector is installed at signalized roadway intersections that are to have the signals preempted by emergency vehicles.

Figure 1:
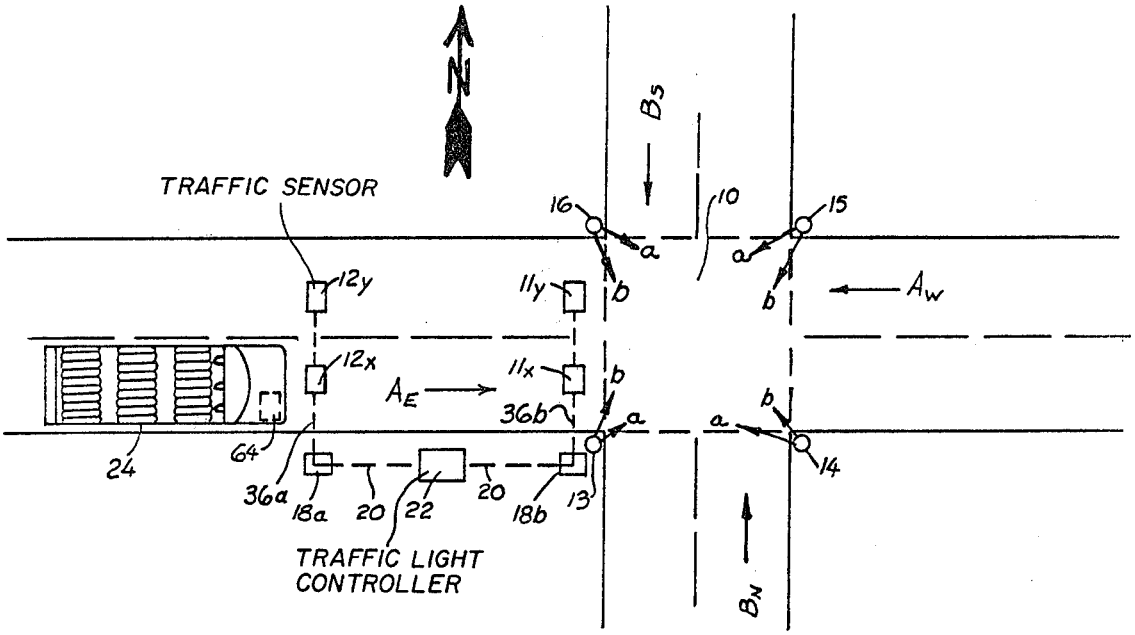
FIG. 1 is a plan view of a signalized intersection showing east-west street Ae—Aw and north-south street Bn—Bs with signal preemption detector sensors 12*x*–12*y* installed on the west leg of the intersection. Fire truck 24 with signal preemption AC current generator 64 approaches the intersection at sensor 12*x*.

Referring to FIG. 1, a signalized intersection 10 includes emergency vehicle sensors 12*x*, 12*y* and 11*x*, 11*y* located at detection points on the west leg of east-west street Ae—Aw in which vehicle traffic is controlled by traffic signals 13, 14, 15, 16. Sensors 12*x*, 12*y*, 11*x* and 11*y* preferably are embedded in the road bed, preferably by forming a small sawcut in the pavement and embedding the sensors in an epoxy resin-base bonding material. The sensors need not be flush with the surface of the roadway but can be operative while embedded under several inches of molded plastic resin which cements them in the pavement.

Figure 3:
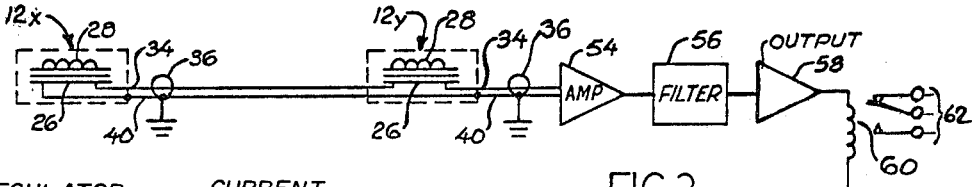
FIG. 3 is a schematic electrical block diagram showing the sensor connected to a system for indicating when the presence of an emergency vehicle having a signal preemption AC current generator that is operative is detected. Filter 56 is designed to pass only the frequency or coded frequencies of the alternating magnetic field surrounding emergency vehicles generated by AC current from the signal preemption AC current generator.

Sensors 12*x* and 12*y*, buried beneath the roadway surface, are connected to a shielded cable 36*a* which is preferably embedded in the roadbed and runs to junction box 18*a*. Sensors 11*x* and 11*y*, also buried beneath the roadway surface, are connected to shielded cable 36*b* which runs to junction box 18*b*. Underground conduit 20 carrying shielded cables 36*a*, 36*b* and other conductors connects junction boxes 18*a* and 18*b* to a traffic signal controller cabinet 22 where the emergency vehicle electronic package 54, 56, 58, 60 and 62 FIG. 3 is stored along with the traffic signal controller and registers a call in the traffic signal controller when an emergency vehicle is over sensor 12*x* or 12*y*. A network of underground conduits, not shown, carrying conductors that connect the output of the traffic signal controller to the signals providing means of actuating the signals when an emergency vehicle such as 24 travels past or is stopped in the vicinity of sensors 12*x* or 12*y*. Sensors 11*x* and 11*y* installed in the pavement identically with sensors 12*x* and 12*y* at the intersection provide a means of returning the traffic signal controller to normal operation as the emergency vehicle 24 or last emergency vehicle detected at 12*x* or 12*y* is detected at the point of detection of 11*x* or 11*y*.

Sensors 12*y* and 11*y* installed in the counter flow side of the street provide a means of detecting emergency vehicles and signal preemption when emergency vehicles are forced to travel on the wrong side of the street by traffic back up at the signal. In the case when an emergency vehicle is traveling west bound (Aw) on street Ae—Aw, the emergency vehicle is detected at sensor 11*y* before it is detected at sensor 12*y* and no call for signal preemption would be placed in the controller. Sensors 12*x* and 12*y* are located at a distance from intersection 10 to provide adequate time for the signal controller to time a full yellow signal (caution) for all traffic having the green signal when preemption is initiated by a call from the emergency vehicle detector and display a red (stop) signal to all cross traffic and provide a green signal for the emergency vehicle by the time it reaches sensors 11*x* or 11*y*. When the emergency vehicle or the last emergency vehicle traveling between sensors 12*x*, 12*y* and 11*x*, 11*y* is detected at sensor 11*x* or 11*y* a second call is registered with the traffic signal controller which causes the controller to return to normal operation after a preselected signal sequence.

Figure 2:
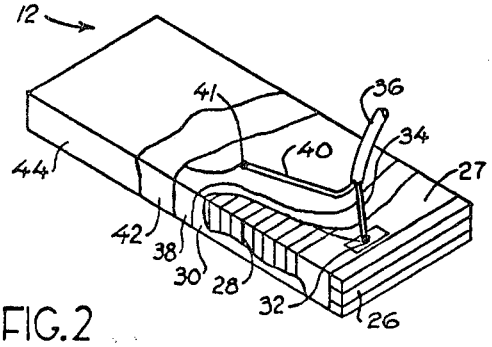
FIG. 2 is a fragmentary perspective view, partially broken away, showing a preferred embodiment of the magnetic field sensor used in this invention and in U.S. Pat. No. 4,083,633, King.

The detailed construction of sensors 12*x*, 12*y* and 11*x*, 11*y* is understood best by referring to FIG. 2 of this invention and FIG. 2 in U.S. Pat. No. 4,038,633, King. The sensor includes a laminated ferromagnetic core 26, preferably three laminations about 0.018 inch thick each, of a ferromagnetic material such as soft iron. A layer 27 of insulating material such as transformer paper covers a major portion of the core. A coil 28 of insulated wire is wound around core 26 and layer 27 leaving ½ inch of core material extending beyond the coil at each end. Preferably, the coil consists of about 700 to 1000 turns of number 48 copper coil wire. A layer 30 of transformer-type insulating paper is wrapped around the coil and the ferromagnetic core. One end of the coil protrudes through the paper layer and is soldered to a copper solder tab 32 which is glued to the insulating paper and is thereby insulated from the other end of the coil and the core. A center conductor 34 of a shielded cable 36 also is connected to solder tab 32. A layer of copper foil 38 covers the layer 30 of insulating paper. The layer of copper foil provides a solder base for sheathing 40 of the shielded cable and the opposite end of coil wire 28, both being mutually soldered to copper foil layer 38 at 41. A layer 42 of thin copper foil completely encloses copper foil 38 and the remaining components of the sensor. Insulating tape (not shown) placed over tab 32 insulates it from the copper foil shielding. An outer layer 44 of insulating tape is wrapped on top of the layer of copper foil to complete the enclosure.

The main purpose of copper foil layers 38 and 42 is to shield the sensor against pick up of radio frequency energy, such as that which can be generated by the spark in the firing system for spark plugs in the ignition system of an automobile.

Figure 4:
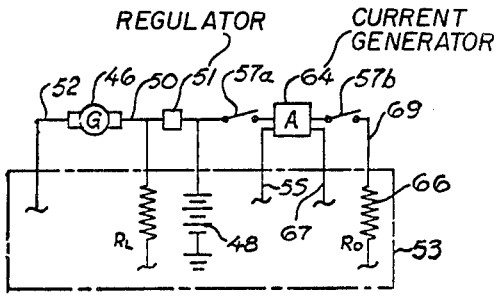
FIG. 4 is a schematic electrical diagram illustrating the electrical system of an emergency vehicle showing preemption AC current generator 64 with input power circuit connected to battery circuit 48 through 57*a* (½ of double pole on-off switch 57*a, b*) and conductor 55. The output AC current circuit comprises switch 57*b*, conductor 69, dummy load 66, emergency vehicle chassis 53 and return conductor 67 (dummy load 66 may be replaced by a useful load such as the emergency vehicle siren and beacon).

FIG. 4 shows in schematic form the electrical system of an emergency vehicle with AC current alternator 64 installed in the battery circuit of the emergency vehicle to produce a circulating AC current through the body and frame of the vehicle with a frequency or coded frequencies reserved for emergency vehicles, the AC current producing an alternating magnetic field of the same frequency or coded frequencies that surrounds the emergency vehicle. FIG. 4 shows the components of the emergency vehicles conventional electrical system, generator or alternator 46, regulator 51, battery 48, electrical load R1 and electrical wiring 50 and 52 which carry pulsating DC current the ripple of which has a frequency range from about 90 Hz to 6 KHz depending on the speed (RPM) of the vehicles engine. This range of frequencies or frequency band encompasses the frequency of alternating magnetic fields radiated by all motor-driven vehicles traveling on roadways that are detected by the detection system described in U.S. Pat. No. 4,038,633, King. To distinguish emergency vehicles from all other vehicles traveling on roadways, an AC current generator of special design (electro-mechanical or electronic) is installed in the battery circuit of emergency vehicles with the sole purpose of generating an AC current with a predetermined fixed frequency or coded frequencies reserved for emergency vehicles outside the band of frequencies of alternating magnetic fields radiated by vehicles with conventional alternators, generators or magnitos. Alternating magnetic fields generated by current from the emergency AC current generator into the external circuit including the body and frame of the emergency vehicle can be detected with a vehicle detector of special design similar to the vehicle detection system described in U.S. Pat. No. 4,038,633, King, except that filter 56 of FIG. 3 in this invention and FIG. 3 of the King patent has been designed to pass only the fixed frequency or coded frequencies of alternating magnetic fields radiated by emergency vehicles generated by emergency vehicle AC current generator 64, FIG. 4. Emergency vehicle AC current generator 64 is connected to the battery circuit of the vehicle through switch 57*a*, ½ of double pole on-off switch 57*a* and 57*b*, and conductor 55 to supply constant DC voltage to drive emergency vehicle current generator 64 when switch 57*a* is closed. The output of generator 64 is connected through 57*b*, the other ½ of double pole on-off switch 57*a* and 57*b*, to deliver AC current when the switch is closed with a fixed, predetermined frequency (10 KHz as chosen earlier in this application) or coded frequencies to dummy load 66 (Rd) through conductor 69 with current returning to the output side of generator 64 through the body and frame of the vehicle 53 and conductor 67. Current with a frequency of 10 KHz (cited above) flowing in the circuit, and the body and frame of the vehicle generates an alternating magnetic field with the same frequency surrounding the emergency vehicle which can be detected to identify the vehicle as an emergency vehicle by a vehicle detection system of special design as described under FIG. 3 of this invention.

FIG. 3 shows a schematic block diagram of a preferred system for sensing operation of an emergency vehicle with an operative emergency vehicle AC current generator installed, such as an ambulance, fire truck or police vehicle, and for indicating that the emergency vehicle has been detected. Sensors 12*x* and 12*y* (the circuit of 11*x* and 11*y* are identical to 12*x* and 12*y*) are shown connected in series to the center conductor and shield of shielded cable 36. The center conductor 34 of shielded cable 36 is connected to the input of amplifier 54 along with the grounded cable sheathing 40 so the amplifier will amplify the rather weak signal produced by sensor 12*x* or 12*y*. The output of amplifier circuit 54 passes through an electrical filter stage 56 which filters out all signals with frequencies other than the frequency or coded frequencies induced in sensors 12*x* or 12*y* by the special alternating magnetic field surrounding an emergency vehicle to be detected (10 KHz as a cited example). The output from filter 56 is fed to an output amplifier 58 to drive a suitable output device such as a relay 60 shows in FIG. 3 for providing a continuous output across terminals 62 in response to continuous energization of the output device from an alternating magnetic field which induces current to flow in sensor 12*x* or 12*y* as long as the presence of an emergency vehicle is being detected. Thus, when output device 60 is energized, the output can be used to trigger a suitable control device, such as a traffic signal controller in control cabinet 22 to preempt traffic signals in response to the operation of emergency vehicle AC current generator generating a magnetic field being detected by sensors 12*x* and 12*y*. An identical detection circuit to that of FIG. 3 with sensors 11*x* and 11*y* installed at the intersection place another call with the control device when the emergency vehicle is detected at 11*x* or 11*y* indicating that the emergency vehicle or the last emergency vehicle traveling between sensors 12*x*, 12*y* and 11*x*, 11*y* is passing through the intersection and signal the control device to return to normal operation.

The arrangement of coil 12*x,y*, 11*x,y* as a current-generating element in the circuit shown in FIG. 3 allows the detector of this invention to continuously sense the presence of an emergency vehicle independently of whether the emergency vehicle is in motion so long as its emergency vehicle AC current generator is operative.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. Apparatus for indicating the presence of an emergency vehicle as distinguished from other non-emergency vehicles and the like comprising:

means for generating an identifiable alternating magnetic field that radiates from emergency vehicles with a predetermined, fixed frequency outside the frequency band of alternating magnetic fields surrounding non-emergency vehicles in the 90 Hz to 6 KHz frequency band associated with the pulsating ripple DC current flowing in an electrical system and metallic mass of all motor-driven objects having a rotational electrical generating device driven by the motor to supply necessary current to drive the electrical system of the motor-driven object when the motor of the motor-driven object is operative;

means for detecting the identifiable alternating magnetic field radiating from emergency vehicles with a predetermined frequency as that of an emergency vehicle as distinguished from alternating magnetic fields in the 90 Hz to 6 KHz band radiating from all motor-driven objects generated by pulsating DC current supplied to the electrical system of the motor-driven object by a rotational electrical device driven by the motor of the motor-driven object when the motor is operative;

said means for generating an identifiable alternating magnetic field radiating from an emergency vehicle comprising an AC current generator coupled through an output electrical circuit to an alternating magnetic field radiating source such as the metallic mass incorporated in the motor, body and frame of the emergency vehicle;

said AC current generator connected through a switch and input electrical circuit to a battery circuit of the emergency vehicle as a constant power source to drive an AC current generator which is connected through an output electrical circuit to cause current of a predetermined frequency to flow through the output circuit including body and frame of the emergency vehicle;

said means for detecting the identifiable alternating magnetic field radiating from emergency vehicles with a predetermined frequency comprising means for coupling said detection means to the identifiable changing magnetic field radiated by a flow of alternating current in said AC current generator output circuit installed on emergency vehicles for the purpose of identification;

said coupling means comprising a signal developing means and an electric probe connected through an electrical connection to the input of said signal developing means to continuously detect the presence of an emergency vehicle in close proximity to said coupling means independently of whether the emergency vehicle is in motion;

said signal developing means comprising an electrical filter, signal amplification means, signal detection means and an indicating means all connected in sequence;

said detection means converts the AC signal to a voltage level suitable to drive the indicating means which indicates the presence of an emergency vehicle at said electrical probe.

2. Apparatus according to claim 1 in which said alternating current generator is installed on emergency vehicles to provide an identifiable alternating magnetic field radiating from the emergency vehicle with a predetermined frequency within a frequency band from 6 KHz to 70 KHz;

said alternating current generator is electronic having solid state circuitry with power provided by the emergency vehicle battery circuit to drive oscillator, amplifier and output circuits of the current generator connected in tandem to produce alternating current at the frequency supplied to the circuit of the magnetic field radiator.

3. Apparatus according to claim 1 in which the electrical probe of the coupling means senses alternating magnetic fields in the frequency band above 6 KHz.

4. Apparatus according to claim 1 in which said signal developing means including said filter is tuned to pass only the frequency of the electrical signal induced in the electrical probe of the coupling means by the identifiable alternating magnetic field radiated from emergency vehicles.

5. Apparatus according to claim 4 including:

an electrical coil having ends connected to a shielded cable having a shield and a center conductor, the cable having the shield grounded and the center conductor providing an input to said signal developing means.

6. Apparatus according to claim 5 in which the electrical probe of the coupling means is disposed in traffic lanes to detect emergency vehicles in the lane while in close proximity to the electrical probe of the coupling means, the coupling means through filter, amplifier and detection circuits of the signal developing means actuates an output device which can be connected to the input of a traffic signal controller installed in a cabinet adjacent to the roadway;

the traffic signal controller being responsive to the actuation of a detection output device which initiates a traffic signal preemption sequence in response to the emergency vehicle.

7. Apparatus according to claim 6 in which said signal developing means includes said amplifier coupled through said filter to the electrical probe of the coupling means for generating an output to be fed to the traffic signal controller.

8. Apparatus according to claim 7 in which:

said electrical probe of the coupling means includes a core of ferrite material, and in which the coil includes a multiplicity of turns of relatively fine conductor wire wound around the core.

9. Apparatus according to claim 8 including:

a shield wrapped around said coupling means to shield from radio frequency pickup.

10. Apparatus according to claim 4 in which:

said coupling means further includes a shielded conductor wire with the shield connected to one end of the inductive coil and the center conductor connected to the opposite end for transmitting induced signals to the input of said signal developing means.

11. Apparatus according to claim 5 in which the coupling means includes a core of ferrite material, and in which the coil includes a multiplicity of turns of relatively fine conductor wire wound around the core.

12. Apparatus according to claim 11 including a shield wrapped around the probe of the coupling means to shield from radio frequency pickup.

13. Apparatus according to claim 12 in which the signal developing means input is connected to the coupling means by a shielded cable, the signal developing means producing the output indicating that the emergency vehicle has been sensed.

* * * * *